United States Patent [19]

Plante et al.

[11] Patent Number: 4,464,131

[45] Date of Patent: Aug. 7, 1984

[54] WATER BALLAST COMPARTMENT FOR BUOYANT MARINE DEVICES

[75] Inventors: Joseph L. P. Plante, Charlesbourg; Rolf E. Kluchert, Ste-Foy; Joseph C. M. St-Onge, Neufchatel, all of Canada

[73] Assignee: Her Majesty the Queen in right of Canada, as represented by the Minister of National Defence, Ottawa, Canada

[21] Appl. No.: 358,617

[22] Filed: Mar. 16, 1982

[51] Int. Cl.[3] ..... B63C 9/21

[52] U.S. Cl. ..... 441/29; 441/28; 441/14

[58] Field of Search ..... 441/6, 11, 13, 14, 21, 441/28, 29; 114/122, 125, 333, 121; 102/341

[56] References Cited

U.S. PATENT DOCUMENTS

| | | | |
|---|---|---|---|
| 2,402,143 | 6/1946 | Arenstein | 441/11 |
| 2,497,852 | 2/1950 | Arenstein | 441/11 |
| 2,689,963 | 9/1954 | Jackson | 441/14 |
| 2,790,186 | 4/1957 | Carapellotti | 441/21 |
| 3,464,071 | 9/1969 | Starratt | 441/29 |
| 3,957,009 | 5/1976 | DiPerna | 114/74 R |
| 4,028,759 | 6/1977 | Toups | 441/29 |

*Primary Examiner*—Sherman D. Basinger
*Assistant Examiner*—Rodney Corl
*Attorney, Agent, or Firm*—Stevens, Davis, Miller & Mosher

[57] ABSTRACT

An improvement in buoyant marine devices, such as pyrotechnic markers, the displacement of which normally decreases during operation as a result of weight loss. The device is provided with a ballast means and means to enable the ballast compartment to fill progressively with water whereby, during operation, displacement of water by the marker is maintained to a degree which will ensure that the device remains in operative orientation. In this way, the problem of tilting by marine markers because of a gradual decrease in weight, to the point that the marker may be easily submerged by water and its operation thereby hampered, is significantly reduced.

8 Claims, 1 Drawing Figure

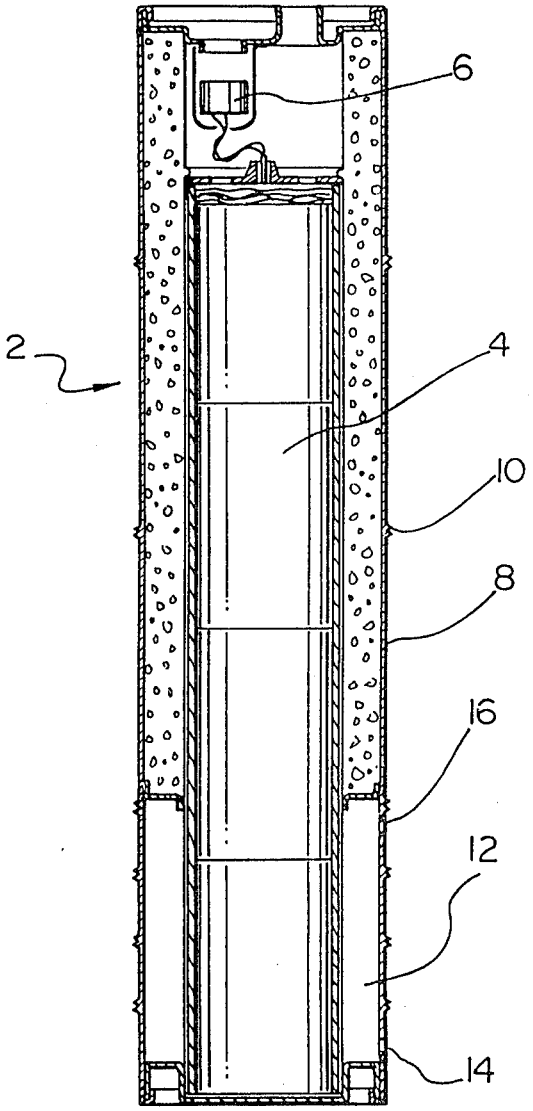
6
2
4
10
8
16
12
14

WATER BALLAST COMPARTMENT FOR BUOYANT MARINE DEVICES

BACKGROUND OF THE INVENTION

This invention relates to elongated buoyant marine devices, the displacement of which decreases during operation as a result of weight loss, such as pyrotechnic marine markers. The invention relates more particulary to improved devices of this type which are more capable of retaining proper operative orientation during their functioning.

Marine markers are frequently used as signalling devices for example they may be displayed in conjunction with sonobuoys by long range marine patrolaircraft during anti-submarine operations. They may also be used for search and rescue operations, for example to mark a wreckage site, or to mark a position at sea (icefloes, oil slicks). These markers are designed to produce smoke and an intense flame, generally by the burning of a pyrotechnic candle or flare. The flare is usually enclosed in an elongated jacket, and for example may consist predominately of red phosphorus which produces dense white smoke and a yellow flame for a period of thirteen to nineteen minutes from time of ignition by a salt water-activated battery and squib combination. Although the marker initially floats vertically in the water, the increase in buoyancy after several minutes of burning causes it to cant until, as the burning continues, the marker usually finally ceases burning in an almost horizontal position on the surface of the water. In other words, because the weight of the marker decreases as the flare burns, its displacement is greater at the beginning of its operation than at the end. As burning continues the marker gradually rises in the water and slowly begins to tip as the burning progresses until, at a time for example halfway through the burn time, it reaches an almost horizontal position which it retains until the end of the burn.

In this final position the combustion gas outlet at the top of the marker is nearer the water than when the marker is in a vertical position. The marker may thus be more easily submerged by waves; water penetrating the marker through the gas outlet can hamper the operation of the marker and cause the flare to burn intermittently or incompletely.

Under ideal burn conditions, for example in calm water where the problem of water penetrating the marker does not arise, the marker will burn continuously for the specific period for which it was designed. In practice however ideal conditions do not prevail and because the markers may burn intermittently or incompletely, it follows that, to obtain effective production of flame and smoke for a given time, a greater number of markers must be used than would be required under ideal burn conditions.

Some marine devices have a flotation collar fitted around their upper part to ensure that the device remains in an upright position while it operates. Flotation collars are made of a rubber-like material which inflates when the device enters the water, or of a buoyant material such as foam rubber or the like. Such flotation collars significantly increase the size and cost of such devices.

Accordingly it is an object of the present invention to provide an effective, more economical construction for such marine marker and other elongated buoyant marine devices, the displacement of which decreases during operation as a result of weight loss, which will be effective in maintaining the device in a vertical, or close-to-vertical, operative position.

SUMMARY OF THE INVENTION

In accordance with the present invention, there is provided in such an elongated buoyant marine device having an operative section enclosed by a jacket a ballast means enclosed by the jacket, and means to enable the ballast compartment to progressively fill with water. During operation, displacement of water by the device is maintained to a degree which will ensure that the device remains in an operative orientation.

The invention may be incorporated for example in an elongated buoyant pyrotechnic marine marker, which marker comprises a pyrotechnic candle, ignition means for the candle, and a jacket enclosing the candle and ignition means, the jacket having a smoke or flame emission hole for the release of smoke or flame produced by the candle when ignited. The marker is provided with a ballast compartment, situated at all times below the centre of gravity when the maker is burning in its normal operative orientation. The marker is provided with one or more water inlet ports in the ballast compartment to enable water to enter the ballast compartment. The marker is also provided with one or more air exhaust ports in the ballast compartment to permit escape of air from the compartment as water is taken on by the ballast compartment. The inlet and outlet ports are of a size to control the filling of the ballast compartment by water so that this filling of the ballast compartment takes place over much of the time during which the marker operates, and hence at a rate so as to compensate for the progressive weight loss of the burning pyrotechnic material. The water inlet ports and air exhaust ports, in a simple, straightforward version of the invention, comprise holes formed in the jacket of the marker, the jacket forming the outer wall of the ballast compartment.

By ensuring that the volume of the ballast means is such that the weight of water entering it increases the weight of the marker by not less than a predetermined percentage of the total weight lost by the marker during operation, the marker is held in a vertical or nearly vertical orientation during operation. It has been found that such markers operate effectively when they are held to no greater than a 20° deviation from vertical. With markers of the shape and construction now in use, it has been found that a volume of ballast means such that the weight of water entering it increases the weight of the marker by not less than 30% of the total weight lost by the marker results in an effective construction and operation of such a marker. This figure of 30% however is quite arbitrary and in general will depend on the configuration and mass of the marker as well as the location of the ballast compartment relative to the centre of gravity.

BRIEF DESCRIPTION OF THE DRAWINGS

Other objects and advantages of the invention will become apparent upon reading the following detailed description and upon referring to FIG. 1 which is a side view, in section, of an exemplary marine marker according to the present invention.

While the invention will be described in connection with specific embodiment, it will be understood that it is not intended to limit the invention to that embodiment.

On the contrary it is intended to cover all alternatives, modifications and equivalents as may be included within the spirit and scope of the invention as defined by the appended claims.

DETAILED DESCRIPTION OF THE INVENTION

Turning to FIG. 1 there is shown an elongated buoyant marine marker 2 of the pyrotechnic type having pyrotechnic candle 4 and ignition means 6 activated by salt water. The entire device is enclosed by jacket 8. Jacket 8 is reinforced by stiffeners 10.

Ballast compartment 12 is provided at the bottom end of the marker, the lower portion of jacket 8 constituting the outer wall thereof. Water inlet port 14 and air outlet port 16 are provided in that part of jacket 8 which constitutes the outer wall of ballast compartment 12.

For the water in which the device is floating to enter ballast compartment 12 gradually throughout the burn period of candle 4, the inlet port or ports 14 must be of a specific size. As indicated on the figure, a minimum of two ports are required, the top port 16 to allow air from compartment 12 to be released through the upper part thereof as water is taken on.

While not shown, the ballast compartment incorporated in the marine marker can be of any shape (cylindrical, ring-shaped, etc.); it is also to be understood that, while not illustrated, two or more ballast compartments, interconnected or not, and of similar or of different shape, may be incorporated in the marine marker to keep it in its vertical position while it is operating . The compartment or compartments must be situated at all times below the centre of gravity when the marker is burning in its normal operative orientation.

The total volume of the compartment (or compartments) should be such that the weight of the water penetrating it (or them) to increase the weight of the marker, corresponds to not less than 30% of the total weight lost by the marker during operation. This ensures a counterbalancing weight capable of holding the marker in a vertical or nearly vertical position (preferably not more than 20° from the vertical position) throughout its operation.

For the cylindrical marine marker illustrated in the accompanying figure, the burn time is about 18 minutes, the overall length 53 cm, diameter 12.4 cm, initial total mass 5.3 kg, and initial mass of the flare 3.9 kg. The volume of the ring-shaped ballast compartment is 0.73 l and corresponds to about 12% of the total volume of the marker, 6.41 l. During operation, the mass of the water entering this compartment accounts for some 52% of the mass lost by the marker, 1.4 kg, through burning of the flare. The diameter of the two port holes, 0.17 cm, ensures a gradual intake of water into the compartment throughout the operation of the marker. The overall net weight loss of the marker during its burn causes it to rise up slightly in the water; some 14 cm of the marker is exposed above the water's surface at the end of burn as compared to 8 cm at the commencement of functioning. This rising of the marker results in its tilting approximately 10° from the vertical orientation.

Thus it is apparent that there has been described in accordance with the invention an elongated buoyant marine marker that fully satisfies the objects, aims and advantages set forth above. While the invention has been described in conjunction with a specific embodiment thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

The embodiments of the invention in which an exclusive property or privilege is claimed are defined as follows:

1. In an elongated buoyant marine device intended for use in a generally vertical position and carrying a pyrotechnic candle which during burning will cause a loss of weight and consequent change in center of buoyancy, including a ballast compartment situated below the center of gravity of the marker when the marker is in said generally vertical position;

at least one water inlet port near the lower end of the ballast compartment for entry of water into said ballast compartment;

at least one air exhaust port near the upper end of the ballast compartment to permit passage of air from said ballast compartment as water enters said ballast compartment, the improvement comprising the size of said ports being selected so that water will enter into and air will exhaust said compartment at a controlled rate so that the filling of the ballast compartment by water takes place over substantially the time during which the candle burns, wherein the increase in weight of the device due to water entry into the ballast compartment will approximately offset the decrease in weight due to burning of the candle at any give time during the burning cycle, whereby the device is maintained in said generally vertical position.

2. A device according to claim 1, having a pyrotechnic candle, ignition means for the candle, and a jacket enclosing the candle and ignition means, the jacket having a smoke or flame emission hole for the release of smoke or flame produced by the candle when ignited.

3. A device according to claim 2, wherein the jacket forms the outer wall of the ballast compartment and wherein the water inlet and air exhaust ports are holes in the jacket of the marker communicating with the ballast compartment.

4. A device according to claim 3 wherein the water inlet port is located in the wall of the ballast compartment near its bottom and the air exhaust port is located in the wall of the ballast compartment near its top.

5. A device according to claim 2 or 1, wherein the volume of the ballast compartment is such that the weight of water entering it increases the weight of the device by not less than 30% of the total weight lost by the device during burning of the candle.

6. A marker according to claim 2 or 1, wherein the volume of the ballast compartment is such that the weight of water entering in it increases the weight of the device by not less than 30% of the total weight lost by the device during burning of the candle, whereby the device is held in an orientation deviating from vertical by no greater than 20°.

7. A device according to claim 2 wherein two or more independent ballast compartments are provided.

8. The device of claim 1, in which the ballast compartment is located between an external jacket and an inner operative section.

* * * * *